United States Patent [19]

Chang

[11] 4,123,595

[45] Oct. 31, 1978

[54] METALLIC COATED ARTICLE

[75] Inventor: David R. Chang, Fairfield, Ohio

[73] Assignee: General Electric Company, Cincinnati, Ohio

[21] Appl. No.: 835,543

[22] Filed: Sep. 22, 1977

[51] Int. Cl.[2] ..... B32B 15/00; B32B 15/18

[52] U.S. Cl. ..... 428/667; 428/660; 428/670; 428/678

[58] Field of Search ..... 428/651, 652, 653, 667, 428/678, 660, 670, 941

[56] References Cited

U.S. PATENT DOCUMENTS

| | | | |
|---|---|---|---|
| 3,869,779 | 3/1975 | Gedwill et al. | 428/652 |
| 3,873,347 | 3/1975 | Walker et al. | 427/405 |
| 3,918,139 | 11/1975 | Felten | 75/171 |
| 3,976,436 | 8/1976 | Chang | 75/171 |
| 3,996,021 | 12/1976 | Chang et al. | 148/31.5 |
| 3,998,603 | 12/1976 | Rairden | 428/651 |
| 4,005,989 | 2/1977 | Preston | 428/651 |

*Primary Examiner*—Arthur J. Steiner

*Attorney, Agent, or Firm*—Lee H. Sachs; Derek P. Lawrence

[57] ABSTRACT

A metallic article is provided with improved resistance to high temperature environmental conditions, particularly hot corrosion resistance, through the interdiffusion with the article substrate of a complex graded coating including an inner portion which includes Al, Cr and at least one of the elements Fe, Co and Ni and an outer portion including at least one element selected from Hf, Pt, Rh and Pd.

5 Claims, No Drawings

METALLIC COATED ARTICLE

The invention herein described was made in the course of or under a contract or subcontract thereunder (or grant) with the Department of the Navy.

CROSS REFERENCE TO RELATED INVENTIONS

This invention is related to patent application Ser. No. 508,747, filed Sept. 24, 1974 now U.S. Pat. No. 4,080,486, issued Mar. 21, 1978 and to concurrently filed application Ser. No. 835,542, each relating to a coated metallic article of improved environmental resistance, and assigned to the assignee of the present invention.

BACKGROUND OF THE INVENTION

This invention relates to metallic articles coated for improved environmental resistance, particularly hot corrosion resistance at elevated temperatures, and, more particularly, to such articles having a complex, graded coating interdiffused with the substrate.

The high temperature operating conditions of a gas turbine engine presented designers with a problem associated with component surface deterioration as a result of oxidation under such conditions. As a result, there have evolved a number of coating systems to protect the surfaces of those high temperature operating components such as turbine blades and vanes during operation in gas turbine engines. However, operation of such apparatus near or on bodies of salt water has presented additional problems associated with hot corrosion, the mechanism for which differs from oxidation.

It has been known for many years to improve environmental resistance of metallic articles through an aluminum or an aluminide coating. However, more recent efforts, which recognize the various types and interrelationships of surface oxides, have been reported. For example, U.S. Pat. No. 3,996,021—Chang, issued Dec. 7, 1976, recognizes the benefit of including in a surface coating the element Hf to provide $HfO_2$ for improved coating life. In addition, U.S. Pat. No. 3,976,436—Chang, issued Aug. 24, 1976, describes the benefits of including such elements as Pt, Rh and Pd along with Al and Hf for improved environmental resistance. Additional benefit has been disclosed in U.S. Pat. Nos. 3,874,901 and 3,998,603—Rairden, III, through the use of an overlayer of aluminum. The disclosure of each of such patents is incorporated herein by reference.

SUMMARY OF THE INVENTION

It is a principal object of the present invention to provide a metallic article having improved resistance to high temperature sulfidation or hot corrosion along with good oxidation resistance.

A more specific object is to provide such an article having an improved coating system for metallic superalloy substrates to enhance high temperature sulfidation resistance.

These and other objects and advantages will be more clearly understood from the following detailed description and the examples, all of which are intended to be typical of rather than in any way limiting on the scope of the present invention.

Briefly, the present invention provides a metallic article including a superalloy substrate based on an element selected from Fe, Co and Ni and into which is diffused a graded coating to increase hot corrosion resistance, as well as to provide good oxidation resistance, at elevated temperatures. The diffused, graded coating includes an inner coating portion, adjacent to and diffused with the substrate, and including Al, Cr and at least one element of the group Fe, Co and Ni, along with elements diffused from the substrate and the outer coating portion. Adjacent to and diffused with the inner coating portion is an outer coating portion which includes 5–50 weight percent of at least one element from the group Hf, Pt, Rh and Pd, along with elements diffused from the substrate and the inner coating. In one form, the inner coating portion consists essentially of, by weight, 8–30% Al, 10–50% Cr, up to 10% Hf, up to 30% of elements selected from Pt, Rh and Pd, up to 3% Y, with the balance selected from the substrate elements, predominantly Fe, Co and Ni.

In one preferred form, the diffused outer coating portion consists essentially of, by weight, 2–5% Hf and 5–40% Pt along with elements diffused from the inner coating portion. In a preferred form, the inner coating portion consists essentially of, by weight, 8–20% Al, 10–40% Cr, up to 5% Hf, up to 20% Pt, up to 2% Y, with the balance at least one element selected from Fe, Co and Ni.

DESCRIPTION OF THE PREFERRED EMBODIMENTS

Recent emphasis on coatings for high temperature environmental protection of the superalloy articles has been on the MCrAlY-type coating in which the "M" is at least one of the transition triad elements Fe, Co and Ni. One useful range for such a coating, as shown by the above-identified, incorporated patents, is, by weight, 8–30% Al, 10–50% Cr, up to 3% Y with the balance at least one of the M elements. Such coatings have been reported as being applied to a substrate by a variety of methods including physical vapor deposition, flame or plasma spraying, sputtering, electron beam deposition, etc. After such deposition, the coating can be diffused with the substrate.

In the above-identified U.S. Pat. No. 3,874,901—Rairden, III and the application cross referenced above, it was recognized that the provision of a multiportion coating system provided improved environmental resistance through the use of an aluminizing overcoating. The present invention provides a significant improvement on such known systems or coatings through the provision of a graded coating of improved multiple portions. The inner portion provides the MCrAl-base type diffused alloy and an outer portion of the coating adjacent to and diffused primarily with the inner portion includes 5–50 weight percent of the elements Hf, Pt, Rh and Pd, shown to provide significant improvement over a single-coating portion as defined in the above-incorporated, U.S. Pat. Nos. 3,976,436 and 3,996,021. More specifically, it has been recognized through the present invention that through use of an overlayer or outer coating portion including 5–50 weight percent of the elements Hf and Pt, a significant improvement in hot corrosion resistance is provided. This is achieved after interdiffusion between the substrate, the inner portion and the outer portion, creating a regenerating outer barrier of interrelated oxides which continue, during high temperature operation of the coated article, to provide significant hot corrosion resistance along with good oxidation resistance. The article of the present invention is partially dependent on the formation of dense $\alpha$-$Al_2O_3$ to resist degradation.

However, under hot corrosive environments, in addition to the spallation of $\alpha$-$Al_2O_3$, there are at least two additional factors which cause faster degradation of the coating. One is the fluxing of $Al_2O_3$ by molten salt, the other is the rapid diffusion and reaction of sulfur through scale and coating materials. Using an Hf or Pt, or both, overlay the availability of Al, diffused from the inner coating portion, to reform $Al_2O_3$ is enhanced by increasing Al activity. The addition of Hf and Pt improves the $Al_2O_3$ scale adherence as well as its salt fluxing resistance. Both concepts have been demonstrated to be effective by the test results.

The coating associated with the present invention is defined as a "graded" coating in that the concentrations of the various elements vary from the substrate through the inner coating portion and through the outer coating portion as a function of the degree of interdiffusion between the substrate and such portions. Thus, after diffusion, the inner coating portion is predominantly of the MCrAl-base type and the outer coating portion is 5–50 weight percent of the elements Hf, Pt, Rh and Pd, each along with an amount of other elements depending on their diffusion between the substrate and the inner and outer coating portions.

During the evaluation of the present invention, a variety of coating combinations were evaluated. The following Table I provides preferred composition ranges for the coating portions after interdiffusion. The graded inner coating portion was selected from the range, by weight, of 8–30% Al, 10–50% Cr, up to 10% Hf, up to 30% of at least one element selected from Pt, Rh and Pd, up to 3% Y with the balance predominantly at least one of the elements Fe, Co and Ni. The graded outer portion was not included in one example, was included as Al in another and, representative of the present invention, an example included, by weight, Pt in the range of about 20–40% Hf in the range of 2–5%.

TABLE I

| | DIFFUSED COATING COMPOSTIONS (Wt. %) | | | | | | | |
|---|---|---|---|---|---|---|---|---|
| | Graded Inner Portion | | | | Graded Outer Portion | | | |
| Ex. | Bal | Cr | Al | Y | Al | Pt | Hf | Bal |
| 1 | Co | 20–30 | 9–16 | .02–.05 | | | | |
| 2 | Co | 20–30 | 9–16 | | 10–50 | | | * |
| 3 | Co | 20–30 | 9–16 | | | 20–40 | 2–5 | * |

* Balance diffused from inner coating and substrate.

TABLE II

| CYCLIC DYNAMIC HOT CORROSION LIFE<br>1700° F/5 ppm sea salt solution<br>Total coating thickness: 4 mils<br>Substrate Alloy Ni-Base Rene' 80 Alloy | |
|---|---|
| Diffused, Graded Coating (Example) | Nominal Life (hrs) |
| 1 | 1200 |
| 2 | 2000 |
| 3 | >3000 |

TABLE III

| Hot Corrosion and Oxidation Data<br>Coating attack (in mils) after 1000 hrs. | | |
|---|---|---|
| Diffused, Graded Coating (Example) | Hot Corrosion 1700° F | Oxidation 2000° F |
| 1 | 3 | 15 |
| 2 | 2 | 12 |
| 3 | 0.2 | 6 |

The data of the above Tables II and III show the improved environmental resistance of the present invention through a comparison of its hot corrosion life and oxidation data with known coated articles. The present invention is represented by the Example 3 composition from Table I. The known coatings are represented by a CoCrAlY-type single-portion coating (Example 1), a CoCrAl-type coating with an aluminum overcoating of the type described in the above-referenced U.S. Pat. No. 3,874,901—Rairden, III and the application cross referenced above (Example 2). The known coatings and that associated with the present invention were applied to test specimens of a nickel-base alloy, sometimes referred to as Rene' 80 nickel-base superalloy consisting nominally, by weight, of 0.15% C, 14% Cr, 5% Ti, 0.015% B, 3% Al, 4% W, 4% Mo, 9.5% Co, 0.06% Zr with the balance Ni and incidental impurities. In order to simulate gas turbine engine operating conditions in the vicinity of bodies of salt water, the cyclic dynamic test employed a 5 ppm seal salt solution. Such test involved exposing the specimens at 1700° F. while, once an hour, cooling the specimens rapidly at 500° F. for about one minute before recycling them to 1700° F. The inner or first coating portion, which is of the MCrAl-base type, was applied to the test specimens, in each example by physical vapor deposition. In Example 2, Al in the outer portion was applied through the use of a pack coating process of the type generally described in U.S. Pat. No. 3,667,985—Levine et al, issued June 6, 1972, with the pack ingredients being varied, as is well known in the art, to provide the composition desired. It should be understood, however, that a variety of methods, some of which are mentioned above, can be used to apply the various coating portions.

The coating system of Example 3 in Table I was applied by first depositing CoCrAl through physical vapor deposition. Then the article thus coated was placed in a powder pack of the type described in the above-incorporated U.S. Pat. No. 3,996,021—Chang et al in which the element Hf was present. Then Pt was applied through sputtering.

With reference to Table II, it can be seen that the coating of Examples 1 and 2, representing known coating systems, have a significantly lower hot corrosion life than does the graded coating system of the present invention, represented by Example 3 from Table I.

The unexpected and unusual results in environmental resistance through the present invention is further demonstrated by the data of Table III, representing both hot corrosion and oxidation data. In that Table, a comparison is shown between the known coating systems represented by Examples 1 and 2 with articles coated according to the present invention represented by Example 3. The remarkable improvement in hot corrosion resistance as well as improvement in oxidation resistance is easily recognized by those skilled in the art. The data of Table III were obtained in a hot corrosion evaluation at 1700° F. using a jet engine fuel, identified as JP5 fuel, along with 5 ppm sea salt injection. The specimens were heated and cycled as described above in connection with Table II. The oxidation data were obtained using natural gas combustion to expose the specimens to 2000° F. while, six times per hour, cooling the specimens rapidly to 700° F. for about one minute before recycling to 2000° F.

Although the present invention has been described in connection with specific examples and embodiments, it will be recognized by those skilled in the art the modifications and variations of which the present invention is capable. It is intended to include within the scope of the appended claims all such variations and modifications.

What is claimed is:

1. A metallic article comprising:

a substrate of a superalloy based on an element selected from the group consisting of Fe, Co and Ni, and a graded coating diffused with said substrate to increase the hot corrosion resistance of the substrate, the graded coating consisting essentially of:

(i) an inner coating portion adjacent to and diffused with the substrate, and consisting essentially of, by weight, 8–30% Al, 10–50% Cr, up to 10% Hf, up to 30% of elements selected from the group consisting of Pt, Rh and Pd, up to 3% Y, with the balance at least one element selected from the group consisting of Fe, Co and Ni, and elements diffused from the substrate and the outer coating portion and (ii) an outer coating portion adjacent to and diffused with the inner coating portion, and consisting essentially of 5–50 weight percent of elements selected from the group consisting of Hf, Pt, Rh and Pd, with the balance elements diffused from the inner coating portion.

2. The article of claim 1 in which the outer coating portion includes 2–5% Hf and 5–40% Pt.

3. The article of claim 2 in which the outer coating portion includes 20–40% Pt.

4. The article of claim 1 in which the inner coating portion consists essentially of, by weight, 8–20% Al, 10–40% Cr, up to 5% Hf, up to 20% of at least one element selected from the group consisting of Pt, Rh and Pd, up to 2% Y with the balance at least one element selected from the group consisting of Fe, Co and Ni.

5. The article of claim 4 in which the Al is 9–16% and the Cr is 20–30%.

* * * * *